US005565651A

United States Patent [19]

Kim et al.

[11] Patent Number: 5,565,651

[45] Date of Patent: Oct. 15, 1996

[54] METHOD FOR PREPARING A COMPACTABLE COMPOSITE EXPLOSIVE

[75] Inventors: Hyung S. Kim; Hyoun S. Kim, both of Daejon, Rep. of Korea

[73] Assignee: Agency for Defence Development, Rep. of Korea

[21] Appl. No.: 222,178

[22] Filed: Apr. 4, 1994

Related U.S. Application Data

[63] Continuation of Ser. No. 847,200, Mar. 6, 1992, abandoned.

[30] Foreign Application Priority Data

Mar. 6, 1991 [KR] Rep. of Korea ..... 3606/1991

[51] Int. Cl.[6] ..... C06B 21/00; C06B 45/10

[52] U.S. Cl. ..... 149/19.92; 149/19.91; 149/11; 264/3.1; 264/3.4

[58] Field of Search ..... 149/19.91, 11, 149/19.92, 19.93; 264/3.1, 3.4

[56] References Cited

U.S. PATENT DOCUMENTS

| | | | |
|---|---|---|---|
| 3,296,041 | 1/1967 | Wright | 149/2 |
| 3,338,764 | 8/1967 | Evans | 149/19.91 |
| 3,428,502 | 2/1969 | Evans | 149/19.91 |
| 3,888,707 | 6/1975 | Rothenstein | 149/19.91 |
| 4,090,894 | 5/1978 | Reed et al. | 149/19.91 |
| 4,113,811 | 9/1978 | Helfgen et al. | 149/19.91 |
| 4,952,255 | 8/1990 | Stanton | 149/19.91 |

OTHER PUBLICATIONS

MRL Technical Report MRL–TR–89–33, Authors I. J. Dagley, et al., entitled "An Evaluation Of Ethylene–Vinyl Acetate Copolymers As Desensitizers For RDX In Insensitive Booster Compositions Prepared BYI The Slurry Coating Technique," 1989.

"The Susan Test for Evaluating the Impact Safety of Explosive Materials", G. D. Dorough et al, Lawrence Radiation Laboratory, University of California, Livermore, California, Aug. 1965.

Guralnik (ed.), Webster's New World Dictionary of the American Language, 2nd College Ed., World Pub. Co. (1970) N.Y., pp. 26 & 299.

*Primary Examiner*—Edward A. Miller
*Attorney, Agent, or Firm*—Christie, Parker & Hale, LLP

[57] ABSTRACT

A compactable composite explosive consisting of 90 weight % to 95 weight % of a raw explosive material being RDX, 5 weight % to 10 weight % of ethylene vinyl acetate copolymer resin containing vinyl acetate in a content of 10 % to 20 % and 0 weight % to 0.5 weight % of dioctyl adipate (D.O.A.) or graphite. This composite explosive is usable as a main charge or a booster of a highly precise arms system. The invention also provides a method for producing a compactable composite explosive, which comprises the steps of dissolving a binder of ethylene vinyl acetate copolymer resin in a solvent of toluene to prepare a solution, injecting the solution into RDX dispersed in a water, forming a granular product from the obtained mixture, distilling primarily the product, *adding toluene into the product, and distilling secondarily the product. The amount of added toluene is 1.0 time to 3.0 times the amount of the binder measured after the primary distillation. The grain size of a final product can be freely controlled according to the amount of added toluene.

1 Claim, No Drawings

METHOD FOR PREPARING A COMPACTABLE COMPOSITE EXPLOSIVE

CROSS-REFERENCE TO RELATED APPLICATION

This is a continuation of Ser. No. 07/847,200, filed Mar. 6, 1992, and now abandoned.

BACKGROUND OF THE INVENTION

1. Field of the Invention

The present invention relates to a compactable type composite explosive using ethylene vinyl acetate copolymer resin as a binder and a method for the preparation thereof.

In particular, the present invention concerns to a compactable composite explosive wherein a raw explosive material of RDX is coated with a binder, so as to be agglomerated into grains. In this case, the present invention provides a compactable composite explosive which is made by using ethylene vinyl acetate copolymer resin containing vinyl acetate in a content of 10% to 20% as the binder and, if necessary, using additionally dioctyl adipate (D.A.O.) or graphite as an additive. The binder and the additive are coated onto grain surfaces of the raw explosive material.

The present invention also concerns to a method for producing the above compactable composite explosive. In this case, the present invention provides a method wherein in addition to conventional steps of dissolving ethylene vinyl acetate copolymer resin in a solvent of toluene to prepare a solution and injecting the solution into RDX dispersed in water, so as to obtain coating and agglomerating effects, a further step of adding toluene into the product and distilling secondarily the product is performed, so as to control the grain size of a final product.

Description of the Prior Art

Such a compactable composite explosive is of a granular type obtained by adding a binder to high explosive powder and conglomerating powder coated with the binder into grains and is expected to exhibit effects of an increase in charging density and an insensitivity to outside impact. This composite explosive is generally used as a main charge or a booster of a highly precise arms system.

In producing the compactable composite explosive, the binder should be dissolved in a solvent having a superior solubility, so as to form a liquid phase solution. As the liquid phase solution is injected into a slurry solution which is formed by dispersing high explosive powder in a water, the binder is coated onto the high explosive powder and conglomerates the powder into grains, by virtue of the difference in solubility between the solution and the water. This is a basic principle of a general method for producing the compactable composite explosive. In this case, control of the grain size of product can be more easily achieved, as the difference in solubility between the solution and the water is higher. On the other hand, ethylene vinyl acetate copolymer resin has a superior solubility to toluene, whereas toluene has a inferior solubility to water. As a result, it is difficult to control the grain size of final product. Furthermore, where coating of the binder is difficult, due to a surface characteristic of a raw explosive material, the produced compactable composite explosive has a sensitivity to outside stimulating factors.

The sensitivity means a property that the explosive is explodable by being fired owing to an undesirable irregular physical phenomena such as outside heat or impact. Accordingly, highly precise arms systems require safe explosives having a lower sensitivity. Generally, as the density of charged explosive is close to the theoretical maximum density (TMD), the explosive is more insensitive to a shock. At this time, the performance of explosive increases. Therefore, it is required for the explosive to have the maximum charging density possible.

In the case of a compactable composite explosive using ethylene vinyl acetate copolymer resin as a binder, the more the content of vinyl acetate increases, the more the compactability increases. In this case, there is an advantage provided by a compactability lower temperature. In terms of safety, it is well-known that the more the content of vinyl acetate increases, the more the insensitivity of explosive to shock increases. After the research of the inventors, however, it was found that the safety was greatly affected by the material characteristic of used binder. As a result, it may be necessary to evaluate the characteristics of explosives which depend upon the product to be obtained and the composition.

SUMMARY OF THE INVENTION

Therefore, an object of the invention is to provide a compactable type composite explosive composition using ethylene vinyl acetate copolymer resin containing vinyl acetate in a content of 10% to 20%, as a binder, thereby exhibiting improved compactability and superior safety, and a method for producing the same.

Another object of the invention is to provide a method for producing a compactable composite explosive, wherein a step of adding a solvent is used, thereby enabling the grain size of a final product to be freely controlled and the coated condition of binder onto the explosive powder to be good.

In particular, in case of a method for producing a compactable composite explosive which uses toluene as a solvent, the grain size and the coated condition are determined by working parameters in a distillation process, so that the grain distribution of final product can not be optionally controlled. The present invention provides a method for producing a compactable composite explosive, enabling the control of the grain distribution, by producing a primarily distilled product by performing first and second steps and then performing a third step of distilling secondarily the primarily distilled product by adding a solvent thereto.

DESCRIPTION OF THE PREFERRED EMBODIMENTS

A binder which is usable within the scope of the invention includes ethylene vinyl acetate copolymer resin containing vinyl acetate in a low content of 10% to 20%. As a raw explosive material, cyclotrimethylenetrinitramine (RDX) is used, which is classified into the powder phase classification of National Defence Standard of the Republic of Korea (ND-1376-0005). An additive is used, which includes D.O.A. (Dioctyl Adipate) or graphite. Preferably, the content of RDX is 90 weight % to 95 weight %, the content of ethylene vinyl acetate copolymer resin 5 weight to 10 weight %, and the content of D.O.A. or graphite 0 weight % to 0.5 weight %.

The method for producing the compactable composite explosive in accordance with the present invention comprises three steps, as follows.

First Step

Ethylene vinyl acetate copolymer resin containing vinyl acetate in a content of 10% to 20% and D.O.A. are dissolved in toluene. At this time, the amount of toluene is 5 times to 10 times the weight of the binder. This step is carried out at a temperature of 70° C. to 80° C. The mixture is sufficiently agitated for about 2 hours, so as to produce a liquid phase solution.

Second Step

RDX is dispersed in a water. At this time, RDX may be prepared by mixing A-Classification and E-Classification of the National Defence Standard at a ratio of 3:1. Alternatively, RDX may consist of A-classification alone. The amount of water used is 6.0 times to 8.0 times the weight of RDX used. For improving the dispersion of RDX in water, gelvatol is used, which has a content of 0.001% to 0.004% based on the weight of water. After injection of the contents into the water, the binder solution prepared at the first step is injected into the water so that RDX is coated with the binder and then agglomerated into grains. Thereafter, the mixture is heated to 95° C., so as to distill toluene. After heating, the mixture is cooled to a temperature of 70° C. to 75° C.

Third Step

Based on the measurement of the amount of toluene distilled at the end of the second step, the amount of remaining toluene is calculated. To obtain a desired grain size, toluene is further added into the mixture. The amount of added toluene corresponds to 1.0 time to 3.0 times the weight of ethylene vinyl acetate copolymer resin. By virtue of added toluene, the grain size of the produced compactable composite explosive increases gradually. Accordingly, it is possible to Control the grain size, according to the amount of added toluene. Under the condition that the grain size has been controlled to a desired value, by adjusting the amount of added toluene, the mixture is heated again to 100° C., to distill toluene. Thereafter, the product is cooled to 50° C. In order to remove the remaining toluene, the product is rinsed by a large amount of water. Then, the product is passed through a filter cloth, to collect explosive grains. The explosive grains are then dried in a dry furnace, until the content of water therein is no more than 0.05%. Thus, a compact type composite explosive using ethylene vinyl acetate copolymer resin as the binder is obtained. In case where instead of using D.O.A. for improving the compactability, graphite is used, in order to improve a conductivity of explosive and expect the function thereof as a lubricant upon pressing, the addition of graphite is carried out at the second step. That is, upon dispersing RDX in water, graphite is charged together with the RDX. According to this procedure, graphite adheres to the surfaces of RDX. In this case, other procedures are performed in the same manner as those described above.

The present invention will be understood more readily with reference to the following examples; however these examples are intended to illustrate the invention and are not to be construed to limit the scope of the present invention. Among the raw materials used in the examples, RDX is available from Korean Explosive Company, Ltd. in Korea, binder from Hanyang Explosive Company, Ltd. in Korea, D.O.A. Ekyung Industrial Company, Ltd. in Korea, and graphite from S.N.P.E. company in France.

Example 1

A compactable composite explosive having the following composition was made by using a method comprising the following steps.

| | |
|---|---|
| Raw Explosive : RDX, A-Classification | 91.0 weight % |
| Binder : Ethylene vinyl acetate copolymer resin (Content of vinyl acetate is 15%) | 8.5 weight % |
| Additive : D.O.A. | 0.5 weight % |

* First Step

The binder and D.O.A were sufficiently dissolved in toluene at 75° C. for 2 hours, to prepare a binder solution. At this time, the amount of toluene was 7 times the weight of used binder.

* Second Step

RDX was dispersed in a water added with gelvatol. At this time, the amount of RDX was 7 times the weight of RDX. The binder solution prepared at the first step was injected into the water which was then heated to 95° C., so as to achieve a primary distillation. In the primary distillation, the amount of distilled toluene was measured. After the temperature of the mixture reached 95° C., the mixture was cooled to 72° C.

* Third Step

The amount of remaining toluene after the primary distillation was measured. Based on the measured amount of remaining toluene, toluene was added again into the mixture so that the amount of toluene in the mixture was two times the amount of the binder. Thereafter, a second distillation was carried out, by heating the mixture to 100° C. The mixture was then cooled to 50° C. Subsequently, rinsing, filtering and drying were performed.

Example 2

By using the same method as in Example 1, a compactable composite explosive having the following composition was made.

| | |
|---|---|
| Raw Explosive : RDX (Mixture of A-Classification and E-Classification having a mixing rate of 3:1) | 91.0 weight % |
| Binder : Ethylene vinyl acetate copolymer resin (Content of vinyl acetate is 15%) | 8.5 weight % |
| Additive : D.O.A. | 0.5 weight % |

Example 3

By using the same method as in Example 1, a compactable composite explosive having the following composition was made.

| | |
|---|---|
| Raw Explosive : RDX (Mixture of A-Classification and E-Classification having a mixing rate of 3:1) | 91.0 weight % |
| Binder : Ethylene vinyl acetate | 8.5 weight % |

-continued

| | |
|---|---|
| copolymer resin (Content of vinyl acetate is 18%) | |
| Additive : D.O.A. | 0.5 weight % |

Example 4

By using the same method as in Example 1, a compactable composite explosive having the following composition was made.

| | |
|---|---|
| Raw Explosive : RDX (Mixture of A-Classification and E-Classification having a mixing rate of 3:1) | 93.0 weight % |
| Binder : Ethylene vinyl acetate copolymer resin (Content of vinyl acetate is 18%) | 7.0 weight % |

Example 5

A compactable composite explosive having the following composition was made by using a method comprising the following steps.

| | |
|---|---|
| Raw Explosive : RDX | 91.0 weight % |
| Binder : Ethylene vinyl acetate copolymer resin (Content of vinyl acetate is 15%) | 8.5 weight % |
| Additive : graphite | 0.5 weight % |

* First Step

The binder was sufficiently dissolved in toluene at 75° C. for 2 hours, to prepare a binder solution. At this time, the amount of toluene was 7 times the weight of used binder.

* Second Step

RDX was dispersed in a water added with gelvatol. At this time, the amount of RDX was 7 times the weight of RDX. Graphite was then added into the water which was then heated to 75° C. Subsequent procedures were the same as in Example 1.

Example 6

The method for making a compactable type composite explosive having the following composition was the same as in Example 1, except that the addition of D.O.A. at the first step was omitted.

| | |
|---|---|
| Raw Explosive : RDX (Mixture of A-Classification and E-Classification having a mixing rate of 3:1) | 95.0 weight % |
| Binder : Ethylene vinyl acetate copolymer resin (Content of vinyl acetate is 15%) | 5.0 weight % |

Samples were prepared from compactable composite explosives made by the above Examples and then tested to evaluate compactability, grain distribution, and sensitivity to shock and a firm target impact test, among various tentative evaluations. The results were described in the following tables.

Table 1 shows the result of a compression test for samples corresponding to compactable composite explosives which were made by using ethylene vinyl acetate copolymer resin as a binder and using D.O.A. as a plasticizer. After the compression test, all samples exhibited the compressive density that was 98% or more of the theoretical maximum density (TMD).

TABLE 1

(Result of Compression Test)

| Press | Compression Condition | Sample Size | % TMD |
|---|---|---|---|
| 60 ton Press | Pressure: 30,000 Temperature: 90° C. | Diameter: 36 mm Weight: 60 g | 98.3 (Example 1) 98.7 (Example 2) |
| 400 ton Press | Pressure: 20,000 psi Temperature: 90° C. | Diameter: 150 mm Weight: 3.6 Kg | 98.5 (Example 2) |

Table 2 shows the result of a grain size analysis for samples corresponding to the products made by a method including no addition of solvent and a method including an addition of solvent for controlling grain size. Samples 1, 2 and 3 by the method including no addition of solvent were made under the same working condition and with the same composition. They were irregular products exhibiting a wide range of grain distribution. Whereas, Samples 1, 2 and 3 by the method including the addition of solvent were made under the same working condition, but at different contents of solvent. By referring to Table 2, it can be found that the larger the sample number, the more the content of solvent and the larger the grain size. Where there is the addition of solvent, it, therefore, is possible to control the grain size of a final product, thereby obtaining uniform products exhibiting a good coated condition.

TABLE 2

(Result of Grain Size Analysis)

| U.S. Standard | Samples by a method including no addition of solvent | | | Samples by a method including an addition of solvent | | |
|---|---|---|---|---|---|---|
| Sieve No. | 1 | 2 | 3 | 1 | 2 | 3 |
| 4 | — | — | — | — | — | — |
| 8 | — | 4.8 | 16.9 | 2.3 | 6.8 | 11.2 |
| 12 | 0.2 | 23.4 | 55.0 | 21.6 | 43.8 | 49.1 |
| 16 | 8.7 | 56.9 | 87.3 | 63.0 | 73.1 | 90.1 |
| 20 | 41.5 | 82.6 | 97.4 | 86.7 | 87.6 | 97.8 |
| 30 | 77.6 | 95.2 | 98.4 | 95.8 | 94.2 | 98.2 |
| 40 | 93.4 | 98.2 | 98.6 | 97.3 | 96.9 | 98.4 |

* All result values are based on weight % of accumulated remaining amount of explosive grains Table 3 shows the result of a large scale gap test (L.S.G.T.) for various samples corresponding to products containing ethylene vinyl acetate copolymer resin as binder. The L.S.G.T. is a comparative test for measuring a shock strength of a solid type explosive. The test is performed by inserting gaps between an explosive to be tested and a booster and exploding the booster. The possibility of reaction of the explosive sample caused by an impact generated upon the explosion of booster is evaluated, as the result of the test. In this test, the sensitivity of the explosive sample to a shock is measured, depending upon the number (that is, thickness) of cards fitted between the explosive sample and the booster. The explosive sample which uses smaller number of cards is evaluated as a safe explosive exhibiting an insensitivity to a shock. In Table 3, an explosive using ethylene vinyl acetate copolymer resin containing vinyl acetate in a content of 31% was compared, in terms of L.S.G.T. result, with an explosive using ethylene vinyl acetate copolymer resin containing vinyl acetate in a content of 15%, in accordance with the present invention. The latter explosive according to the present invention was evaluated as an explosive exhibiting higher safety to outside impact and higher insensitivity to a shock.

TABLE 3

(Measured Result of Sensitivity to Shock)

| Kind | Content of Vinyl Acetate | Number of Cards | % TMD |
|---|---|---|---|
| Example 5 | 15% | 202.5 | 97.6 |
| Composition A | 31% | 232.1 | 98.9 |

1. Composition A corresponds to U.S. Composition PBXC-13 and is RDX which is available from Korean Explosive Company, Ltd.

2. The thickness of one card is 0.25 mm.

Table 4 shows the result of a firm target impacting test for various samples corresponding to products using different ethylene vinyl acetate copolymer resin binders. The firm target impacting test means a test for evaluating a relative impact sensitivity of an explosive, by measuring the ignition characteristic exhibiting how easy the explosive ignites, depending on the momentum caused by a mechanical impact and the growth characteristic exhibiting the degree of reaction that becomes more severe, depending on the velocity of impact energy increase. The sensitivity of explosive is measured, based on the level of relative reaction energy to the impact velocity or the measured pressure. At the same impacting velocity, the higher the measured pressure, the more severe the reaction. By referring to Table 4, it could be found that products using the binder containing 31% vinyl acetate, as the composition A exhibited a severe reaction at a low impacting velocity and thus a very high sensitivity to an impact generated in flying. On the other hand, the products made by the Example 5 of the present invention, which contain 15% vinyl acetate, as the composition B exhibited a measured pressure that is linearly increased according to the increase of shot velocity and a sensitivity to an impact generated in flying, similar to that of the composition B which is a melt cast explosive. As a result, it could be found that explosives according to the present invention were safe explosives to the impact generated in flying.

Although the preferred embodiments of the invention have been disclosed for illustrative purpose, those skilled in the art will appreciate that various modifications, additions and substitutions are possible, without departing from the scope and spirit of the invention as disclosed in the accompanying claims.

TABLE 4

(Result of Firm Target Impacting Test)

| Shot Velocity | Measured Pressure (psi) | | |
|---|---|---|---|
| (m/sec) | Composition B | Example 5 | Composition A |
| 85 | 0.8 | 0.5 | 13.9 |
| 100 | — | 1.5 | 2.1 |
| 115 | 2.9 | 1.5 | 14.2 |
| 124 | 1.3 | — | — |
| 150 | 1.5 | — | 10.2 |
| 155 | — | — | 14.0 |
| 180 | 2.6 | — | — |
| 200 | 3.2 | 3.1 | 10.1 |
| 215 | 2.7 | 2.3 | — |
| 260 | 3.5 | — | 7.5 |
| 290 | 5.0 | 3.6 | — |
| 320 | — | 4.5 | — |
| 360 | — | 4.4 | — |

What is claimed is:

1. A method for producing a compactable composite explosive product comprising the steps of:

dissolving a binder of ethylene vinyl acetate copolymer resin in a solvent of toluene to prepare a binder solution;

dispersing one part by weight cyclotrimethylenetrinitramine (RDX) powder with between about 6 and 8 parts by weight water to prepare an aqueous slurry of RDX in water;

injecting the binder solution into the aqueous slurry of RDX to coat the RDX with binder and form a primary product mixture containing an agglomerated RDX;

heating the primary product mixture to a temperature of about 95° C. to remove a portion of the toluene and produce a concentrated primary product mixture;

cooling the concentrated primary product mixture to between about 70° and 75° C.;

measuring the amount of toluene remaining in the concentrated primary product mixture;

controlling the agglomerated RDX grain size by adding an amount of additional toluene to the concentrated primary product mixture to produce a secondary product mixture, the amount of additional toluene added being between about 1 to 3 times the amount of binder present in the primary product mixture;

heating the secondary product mixture to a temperature of about 100° C. to remove a portion of the additional toluene from the secondary product mixture and produce a concentrated secondary product mixture;

cooling the concentrated secondary product mixture to about 50° C.;

rinsing the cooled concentrated secondary product mixture with water; and filtering and drying the rinsed concentrated secondary product mixture so that the water content is less than about 0.05% to produce a final explosive product.

* * * * *

UNITED STATES PATENT AND TRADEMARK OFFICE

CERTIFICATE OF CORRECTION

PATENT NO. : 5,565,651
DATED : October 15, 1996
INVENTOR(S) : Hyung S. Kim; Hyoun S. Kim It is certified that error appears in the above-indentified patent and that said Letters Patent is hereby corrected as shown below:

On the title page, ABSTRACT, line 14, change "*adding" to -- adding --.
Column 1, line 24, change "(D.A.O.)" to -- (D.O.A.) --.
Column 1, line 26, replace "grain" with -- powder --.
Column 1, lines 53,54, change "conglomerates" to -- agglomerates --.
Column 1, line 62, before "inferior" change "a" to -- an --.
Column 2, line 15, before "lower" insert -- at a --.
Column 3, line 35, before "added" insert -- the --.
Column 3, line 37, change "Control" to -- control --.
Column 5, line 29, after "RDX" insert -- , A-Classification --.
Column 5, line 51, before "composite" delete "type".
Column 6, line 18, in TABLE 1, after "30,000" insert -- psi --.
Column 6, line 65, before "reaction" insert -- 50% --.

Signed and Sealed this

First Day of July, 1997

Bruce Lehman

*Attest:*

BRUCE LEHMAN

*Attesting Officer*

*Commissioner of Patents and Trademarks*